US012338999B2

(12) United States Patent
Hack

(10) Patent No.: US 12,338,999 B2
(45) Date of Patent: Jun. 24, 2025

(54) BURNER ASSEMBLY, METHOD FOR OPERATING A BURNER ASSEMBLY, AND WIND FUNCTION

(71) Applicant: Viessmann Climate Solutions SE, Allendorf (DE)

(72) Inventor: Sebastian Hack, Marburg (DE)

(73) Assignee: VIESSMANN CLIMATE SOLUTIONS SE, Allendorf (DE)

( * ) Notice: Subject to any disclaimer, the term of this patent is extended or adjusted under 35 U.S.C. 154(b) by 385 days.

(21) Appl. No.: 17/917,219

(22) PCT Filed: Mar. 4, 2021

(86) PCT No.: PCT/EP2021/055480
§ 371 (c)(1),
(2) Date: Oct. 5, 2022

(87) PCT Pub. No.: WO2021/204471
PCT Pub. Date: Oct. 14, 2021

(65) Prior Publication Data

US 2023/0341124 A1 Oct. 26, 2023

(30) Foreign Application Priority Data

Apr. 9, 2020 (DE) ..... 10 2020 204 647.6

(51) Int. Cl.
*F23N 5/24* (2006.01)

(52) U.S. Cl.
CPC ..... *F23N 5/242* (2013.01); *F23N 2229/12* (2020.01); *F23N 2229/22* (2020.01)

(58) Field of Classification Search
CPC ... F23N 5/242; F23N 2229/12; F23N 2229/22
(Continued)

(56) References Cited

U.S. PATENT DOCUMENTS 5,924,859 A * 7/1999 Nolte ..... F23N 5/123 431/18
2002/0048737 A1 4/2002 Lochschmied
2021/0254830 A1 8/2021 Höflinger et al.

FOREIGN PATENT DOCUMENTS

DE 101 13 468 A1 3/2002
DE 100 58 417 A1 6/2002
(Continued)

OTHER PUBLICATIONS

German Office Action, dated Dec. 18, 2020, for German Patent Application No. 10 2020 204 647.6. (12 pages) (with English translation).

(Continued)

*Primary Examiner* — Vivek K Shirsat
(74) *Attorney, Agent, or Firm* — Seed IP Law Group LLP

(57) ABSTRACT

The present disclosure relates to a method for operating a burner assembly comprising a burner (1) burning an air-fuel mixture. In a step of the method, a target value for an ionization current is specified. The burner (1) is operated in a first operating state at a first specified power level. The ionization current (9) is measured using an ionization electrode (5). The measured ionization current (9) is compared with the predefined target value and a deviation is determined. When the deviation exceeds a predefined threshold value, the burner (1) is transitioned to a second operating state at a second power level. The second power level is higher than the first power level. The second power level is determined as a function of the deviation.

7 Claims, 3 Drawing Sheets

(58) Field of Classification Search
USPC ..... 431/2
See application file for complete search history.

(56) References Cited

FOREIGN PATENT DOCUMENTS

| | | | |
|---|---|---|---|
| DE | 10 2018 120 377 | A1 | 2/2020 |
| EP | 2549187 | A2 | 1/2013 |
| JP | H10232019 | A | 9/1998 |

OTHER PUBLICATIONS

International Search Report, mailed Apr. 29, 2021, for International Patent Application No. PCT/EP2021/055480. (5 pages) (with English translation).

* cited by examiner

BURNER ASSEMBLY, METHOD FOR OPERATING A BURNER ASSEMBLY, AND WIND FUNCTION

The present invention relates to a burner assembly and a method for operating a burner assembly. In particular, the present invention realizes a wind function that can prevent flameout due to pressure fluctuations caused by wind.

A burner assembly generally includes a burner connected to the atmosphere through an exhaust system. Strong gusts of wind, such as those occurring during storms, may cause rapidly changing drafts or excess pressure in the exhaust system. This may cause pressure surges in the burner. Such pressure surges may result in a flameout in the burner, which may result in toxic emissions. In addition, after a flameout, a calibration must be carried out when the burner is restarted. In the event of a flameout, calibration is necessary in order to determine whether the burner control is functioning since the cause of the flameout is not always clear. A calibration requires the burner to be forced to run at a high load level. For this, appropriate heat dissipation in the heating system must be ensured, possibly necessitating further control measures.

The object of the present invention is to overcome the problems known in the prior art and to provide a burner assembly for a heating boiler which is improved over the prior art and to provide a method for operating a burner assembly. In particular, a flameout due to pressure surges is to be prevented in order to avoid toxic emissions and mandatory calibration. The measures for avoiding the flameout are also referred to as the "wind function" in the following.

The object is achieved by a method for operating a burner assembly according to the present disclosure. The object is also achieved by a burner assembly according to the present disclosure.

A method for operating a burner assembly including a burner that burns an air-fuel mixture comprises the method steps described below. The order of the steps may be varied depending on the application. Some steps may also be executed simultaneously. In particular, a fluid, i.e. gaseous or liquid, fuel may be used as the fuel, for example natural gas or fuel oil.

In a first operating state, the burner is operated at a first predetermined power level. In particular, the burner is operated at partial load in the first operating state. A preferred partial load range of the first power level may be, for example, between 3% and 10% of the maximum load, more preferably between 4% and 8% and particularly preferably between 5% and 7%.

In one step of the method, a target value for an ionization current is specified. The ionization current may be measured using an ionization electrode arranged so as to be immersed in the flame.

The measured ionization current is then compared with the specified target value and a deviation between the measured ionization current and the specified target value is determined. For this purpose, for example, an electronic control device of the burner assembly, which in particular includes a processor and a memory, may be used.

When the deviation is small, the burner will continue to operate in the first operating mode. In particular, a small deviation is present when the deviation is less than a predefined limit value. When the deviation exceeds the specified limit value, the burner may be switched to a second operating state at a second power level.

The second power level is in a higher partial load range than the first power level. The second power level is therefore also referred to as "raised partial load". A preferred partial load range of the second power level may be, for example, between 20% and 40% of the maximum load, more preferably between 25% and 35% and particularly preferably between 28% and 33%.

In particular, the second power level may be determined as a function of the deviation. This may be carried out, for example, in such a way that the second power level is raised to a higher partial load when the deviation is greater than when the deviation is smaller. Correspondingly, values or an algorithm according to which the second power level is determined as a function of the deviation may be stored in the control device.

By raising the power level to the second power level, i.e. by operating the burner in a higher load range, stable combustion is achieved even when pressure fluctuations affect the flame. This may prevent flameout. Since the power level is determined as a function of the measured deviation, a conventional burner assembly including an ionization electrode can react to pressure fluctuations without additional sensors in order to avoid the flameout. The method according to the invention may therefore also be implemented in older devices.

After a predetermined period of time has elapsed, the burner assembly may be transitioned back to the first operating state. The period of time may be determined, for example, as a function of the measured deviation, or it may be a fixed value. In this way, an operation at an unnecessarily high power level over a longer period of time can be avoided. Since gusts of wind tend to be of short duration, a period of several seconds or a few minutes may be sufficient, for example. In particular, the control device of the burner will try to transition the burner to the lowest possible load level under the conditions, with the conditions being determinable from the deviation of the measured ionization current from the target value.

The transition from the first to the second operating state or from the second to the first operating state may be carried out in steps via one power level or a plurality power levels between the first and second power level. By increasing the power level in steps, the burner assembly can react to pressure fluctuations without immediately modulating to a high power level. After each step of increase, an ionization current may be measured again and compared with the target value. When the deviation is less than the limit value, there is no need to raise the power level further or it may even be modulated back to a lower power level.

When transitioning from the second to the first operating state, the following method steps may be carried out in each power level between the first and second power levels:

First, the burner is operated at the current power level and the ionization current is measured. The measured ionization current is again compared with the specified target value and the deviation is determined. When the deviation exceeds the specified limit value, the burner may be switched to the next higher power level. When the deviation does not exceed the limit value, the burner may continue to be operated at the current power level, or it may be transitioned to the next lower power level after a specified period of time.

The target value of the ionization current may be specified as a function of the current power level. Since the ionization current generated in the ionization electrode depends on the properties of the flame, in particular the temperature, the target value of the ionization current is generally dependent on the power level which is the set point of control.

A modulation rate of the burner may be accelerated by means of a coefficient when the burner is transitioned to a higher power level. Since a flameout is to be avoided, it is advantageous to operate the burner at a higher power level as quickly as possible, particularly in the event of an external disturbance, for example a gust of wind. This may be achieved in increasing the control rate, which may be achieved, for example, by means of a coefficient (or by means of a factor) for increasing the modulation rate, which is described in more detail below.

The modulation rate of the burner means a change in the burner power over time. It may also be understood as the ability of the burner to react to changing thermal requirements. In the case of a burner with a high modulation rate, the burner power may thus advantageously be adapted particularly quickly to changing thermal requirements. In other words, with a burner with a high modulation rate, the burner power may be controlled to reach a higher (or lower) value in a short time.

In order to change the burner power, the amount of air supplied and the corresponding amount of fuel (or amount of gas) supplied must be changed synchronously, i.e. essentially simultaneously and to an extent that is proportional to one another, so that the resulting air ratio changes barely (or as little as possible). The amount of air supplied may be changed, for example, by controlling the speed of a fan for supplying air into the combustion chamber.

When the change in the amount of air supplied and the change in the amount of fuel supplied are not synchronized, combustion with a large amount of noxious CO emissions may result. In addition, the flame might leave an optimal range of combustibility (impending flameout), so that it could be extinguished by a gust of wind, for example. Advantageously, this effect may be counteracted by adjusting the control rate.

A gust of wind may create rapid back pressure in the burner exhaust system. In this situation, there may be a sudden unexpected change, in particular a reduction, in the amount of air available for combustion. Accelerating the fan may primarily result in an increase in the amount of air available for combustion and compensate for the reduction. In this case, modulating the burner at the normal rate (normal low modulation rate configured for undisturbed normal operation) may be too slow to react appropriately to the suddenly changing conditions. This could, for example, lead to a flameout or inefficient combustion with high emissions. In order to avoid these negative effects, the modulation rate of the burner may be increased by means of a coefficient (factor). In this situation, operation without coefficients might mean having to make a poor compromise between saving the flame and shifting the air ratio during modulations.

According to the invention, the modulation rate of the burner may be increased by a coefficient (factor), preferably in the range of three to eight. An exemplary modulation rate in the lower load range (partial load range of the burner power up to approximately 10% of maximum power) is around 1% per second for burners with a modulation degree of 1:20, for example. In the upper load range (partial load range of the burner power from approximately 30% to 100% of maximum power), modulation may be performed at a modulation rate of 15% per second. Which value is selected for the coefficient (factor) may depend in particular on the specific burner behavior and on the modulation rate in the lower load range, which in some burners may also be at lower values than 1% per second, for example 0.7% per second to 0.8% per second.

Furthermore, a time duration of the deviation between the measured ionization current and the target value may be determined, in particular in order to determine the second power level as a function of the duration of the deviation. A longer duration of the deviation is an indication of stronger gusts of wind, for example during a storm. Since strong gusts of wind are to be expected to occur more frequently during storms, the burner is preferably transitioned to a higher second power level in order to avoid a flameout.

Thus, the wind function described above can control the power level of the burner to a stable level when a flameout is imminent. Higher power levels require higher pressure in the combustion chamber, which makes the flame more stable against flameout. The method according to the invention can therefore effectively prevent flameout.

BRIEF DESCRIPTION OF THE DRAWINGS

Further advantageous developments are described in more detail below with reference to an exemplary embodiment illustrated in the drawings, to which the invention is not restricted, however.

In the figures.

DETAILED DESCRIPTION OF THE INVENTION BASED ON EXEMPLARY EMBODIMENTS

In the following description of a preferred embodiment of the present invention, the same reference symbols designate the same or comparable components.

Figure 1:
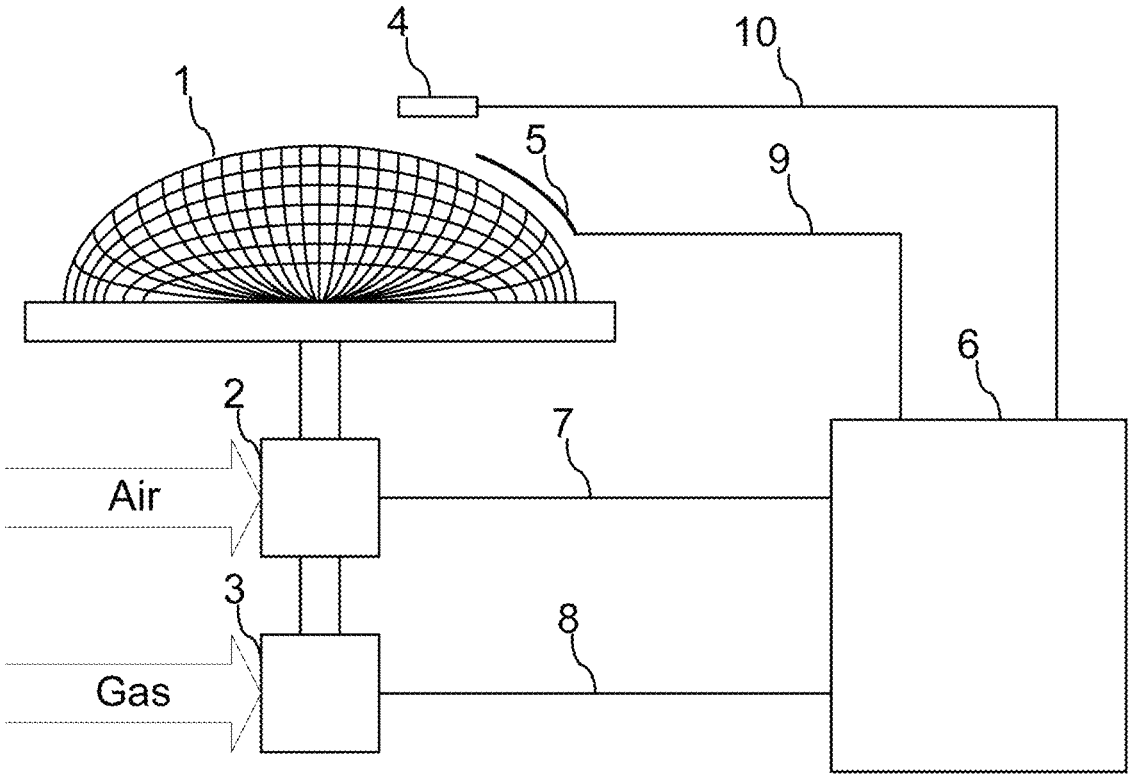
FIG. 1 shows a burner assembly according to an exemplary embodiment of the invention.

FIG. 1 illustrates an exemplary embodiment of a burner assembly according to the invention, which may be used for example in a boiler of a heating system for a building. The boiler may be, for example, a conventional gas boiler or a condensing boiler.

The burner assembly includes a burner 1 which is supplied with a gas-air mixture via a first adjusting device 2 for air and a second adjusting device 3 for gas. The first adjusting device 2 may be, for example, an air fan (e.g., a speed-controlled fan). The second adjusting device 3 may be configured as a proportional valve. The burner 1 is, for example, a 35 kW gas burner. The burner 1 burns the gas-air mixture. The operation of the burner 1 is regulated or controlled by a control device 6 with an automatic firing unit.

An ionization electrode 5 is arranged in the vicinity of the burner 1 and is configured to measure an ionization current 9 and to output it to the control device 6 or the automatic firing control unit via a suitable signal line. When the burner 1 is in operation, i.e. during combustion, the ionization electrode 5 protrudes into the flame. The ionization electrode 5 is usually used for flame monitoring in gas burners since only the presence of a flame causes the ionization current 9 to flow.

Furthermore, a lambda probe 4 may be arranged in the exhaust gas flow of the burner 1. A lambda probe 4 is used to measure the residual oxygen content in the exhaust gas. A more detailed description of the lambda probe 4 and its function is omitted below. In addition, the burner 1 may include other components, such as an ignition, exhaust gas paths and temperature sensors, which are not shown here since they are not necessary for the description of the present invention.

The automatic firing unit 6 outputs control signals 7 and 8 for air and gas to the first 2 and second 3 adjusting devices so that the air ratio λ desired for the respective application can be set during an operating phase and, if necessary, kept constant. The air ratio λ is a dimensionless number characterizing the mass ratio of air to fuel in a combustion process. The combustion air ratio puts the air mass $m_{L,tats}$ actually available for combustion in relation to the minimum stoichiometric air mass $m_{L,st}$ necessary for complete combustion.

$$\lambda = \frac{m_{L,tats}}{m_{L,st}},$$

If λ=1, the combustion air ratio is stoichiometric. This occurs when all of the fuel molecules fully react with the oxygen in the air, leaving no oxygen in the exhaust gas and no unburned fuel. The case λ<1 means lack of air. This is also referred to as a rich mixture. There is more fuel in the air-gas mixture than can react with the oxygen in the air. The case λ>1 means excess air and is also referred to as a lean mixture.

The lambda probe 4 shown in FIG. 1 is not required for the present invention. The method according to the invention does not evaluate the signals from the lambda probe 4. The method can therefore also be used for burners that do not have a lambda probe.

The automatic firing unit 6 records the output signals from the lambda probe 4 and the ionization electrode 5 and processes them further in order to control the combustion. Therefore, the automatic firing unit 6 determines the control signals 7 and 8 for the first 2 and second 3 adjusting devices as a function of the signals 9 and 10. In particular, the automatic firing unit 6 may control a load level using the control signals.

The ionization signal 9 is evaluated by the ionization electrode 5 in order to detect dangerous wind influence. Wind gusts may cause large deviations in the measured value of the ionization signal 9 from the target value specified by the control device 6.

The operation of the burner 1 with the wind function is described in more detail below with reference to the flow chart shown in FIG. 2, which shows the method according to the invention in a simplified manner.

In the first operating state BZ1, the burner 1 is operated at a first power level at partial load of, for example, 5.8% of the maximum load. The ionization electrode 5 measures the ionization current list and outputs a corresponding ionization signal 9 to the firing control unit 6, which at the same time serves as a control device for controlling the combustion and evaluates the ionization current.

The ionization signal 9 is compared with a specified target value $I_{soil}$ and a deviation $\delta=|I_{ist}-I_{soil}|$ between the measured ionization current $I_{ist}$ and the target value $I_{soil}$ is determined. The degree of deviation δ is evaluated using a specified limit value $\delta_{max}$ in order to determine a required increase in the burner load level therefrom. Pressure fluctuations due to wind have a negative impact on combustion and the measured ionization current may therefore deviate from the target value.

When the deviation is less than the limit value (No in FIG. 2), the burner 1 continues to operate in the first operating state BZ1 at the first power level. However, when the deviation is greater than the specified limit value (Yes in FIG. 2), then the burner 1 is transitioned to a second operating state BZ2 in which burner 1 is operated at a higher load level. This raise is intended to prevent an imminent flameout. For example, a deviation of 15% of the ionization current from the target value may be specified as a limit value.

Figure 2:
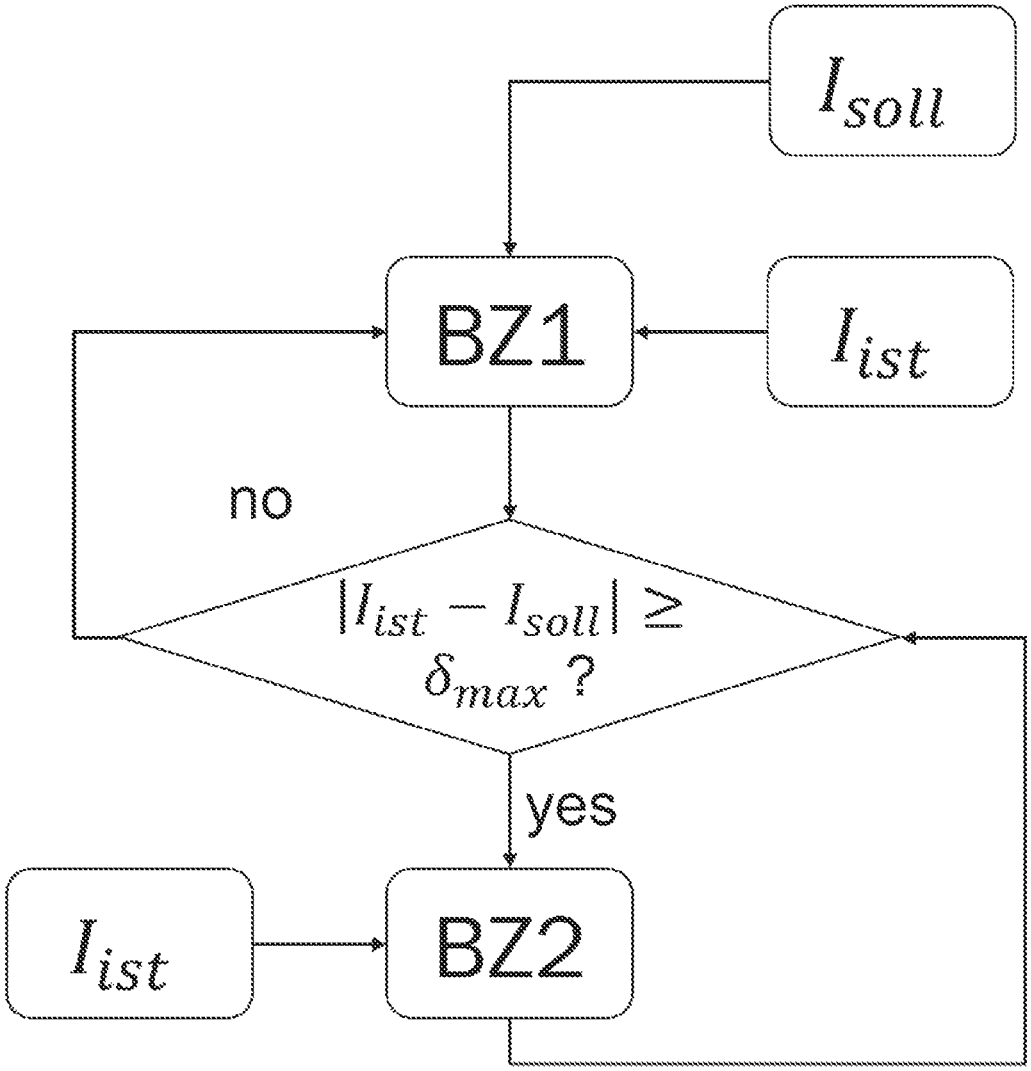
FIG. 2 shows an exemplary embodiment of a method according to the invention.

The power range from the first power level to the increased partial load (second power level) may be divided into five intermediate levels, for example (not shown in FIG. 2). The burner 1 may be operated at each level for a period of, for example, (at least) one minute before a new check is carried out to determine whether the measured ionization current deviates from the target value.

The increased partial load is, for example, 30% of the maximum load. The wind function according to the invention may also determine the duration of the excess of the limit value in the deviation of the ionization current. In this case, a range of a lower time threshold, for example 0.1 seconds, is subdivided linearly up to an upper time threshold. The upper time threshold may be determined on the basis of a process clock that is specified by the automatic firing unit 6. For example, a duration of twenty revolutions of the automatic firing unit 6 may be specified as the upper time threshold.

Thus, the wind function raises the lower limit of the burner power. This remains active for a defined period of time after which the burner 1 may modulate to lower load levels again. The enabling of the lower partial load may also happen in steps. If another wind event occurs, the control device 6 may control the burner 1 again to a higher load level until a level with stable combustion (deviation smaller than the limit value) is reached. The burner 1 can thus be automatically controlled to the lowest possible partial load under the influence of the wind.

A modulation rate when approaching the stable second load level may be accelerated with a coefficient, which may be a factor of 3 to 8, for example. In this way, the burner 1 is transitioned more quickly to a higher load level in order to efficiently prevent the flameout. In other words, the modulation rate of the burner 1 is increased by the control device 6 (in particular for a short time) in order to operate the burner 1 with an optimal air ratio even in the event of an external disturbance (e.g., due to a gust of wind).

In practice, a higher load level may result in target values for a flow temperature of a heating system being reached earlier.

Figure 3:
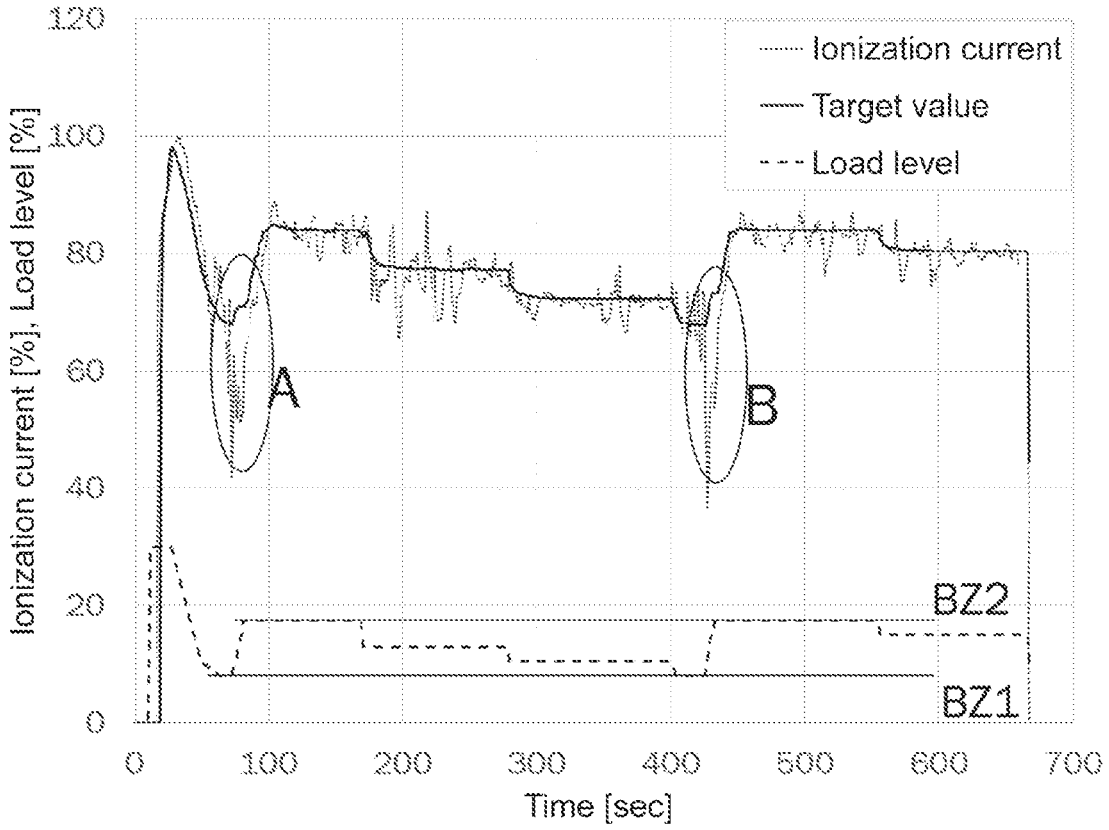
FIG. 3 shows a diagram illustrating typical burner behavior under the influence of wind.

FIG. 3 shows a diagram that illustrates a typical course of the operating state of the burner 1 under the influence of wind. In FIG. 3, the ionization current generated and measured in the ionization electrode 5 (dotted line), the target value specified for the ionization current (solid line) and the load level (dashed line) to which the burner is controlled are plotted over time. The information is in percent, with an ionization current of 100% being specified at a load level of 30% here.

After approximately 10 seconds, a load level of 30% is specified for burner 1. Combustion is started and, after about 30 seconds, the burner 1 reaches an ionization current of about 100%. The specified load level is now reduced to a first load level of 8%, which corresponds to the first operating state BZ1, and the first operating state BZ1 is reached in about 60 seconds. At about 75 seconds, a first wind event A occurs and the combustion is disrupted so that a large deviation between the measured ionization current and the specified target value is determined. As a result, the control device transitions the burner 1 to the second operating state BZ2 with a load level of 17.5%.

The second operating state BZ2 remains active for approximately 90 seconds. As is apparent in the diagram, the deviation between the measured ionization current and the specified target value remains relatively small so that the control device reduces the load level back to the first operating state in a stepwise manner.

The two load levels illustrated here between the first load level of the first operating state BZ1 and the second load level of the second operating state BZ2 are each active for approximately 110 seconds and amount to 13% and 10.5%, respectively. At around 400 seconds on the time axis, the burner is transitioned back to the first operating state BZ1 with a load level of 8%.

At about 430 seconds on the time axis, a second wind event B occurs and the described process of transitioning the burner 1 to the second operating state BZ2 is carried out again. As a result, flameout in the burner can be prevented. An evaluation of the ionization current from the ionization electrode is sufficient for the control described. Since such an ionization electrode is present in most burners, the method according to the invention can be used for most burners without a retrofit with special sensors being necessary.

Although the exemplary embodiments have been described in relation to a gas boiler for a heating system, the method according to the invention for testing and calibrating a lambda probe may also be used in other applications in which a fuel is burned. The burner assembly according to the invention is also not limited exclusively to the combustion of a gaseous fuel. The invention may also be used in an analogous manner in relation to an oil burner or a heating boiler in which wood is used as fuel. Appropriate modification would also make it possible to use the invention in an internal combustion engine.

The features disclosed in the above description, the claims and the drawings may be significant for the implementation of the invention in its various configurations both individually and in any combination.

LIST OF REFERENCE SYMBOLS

1 burner
2 first adjusting device for air
3 second adjusting device for gas
4 lambda probe
5 ionization electrode
6 automatic firing unit (control device)
7 control signal for air
8 control signal for gas
9 ionization current
10 current signal of lambda probe

The invention claimed is:

1. A method for operating a burner assembly comprising a burner burning an air-fuel mixture, said method comprising the method steps of:
- specifying a target value for an ionization current;
- operating said burner in a first operating state at a first specified power level;
- measuring an ionization current by means of an ionization electrode;
- comparing the measured ionization current with the specified target value and determining a deviation; and
- when the deviation exceeds a specified limit:
- transitioning said burner to a second operating state at a second power level,
- wherein the second power level is higher than the first power level,
- wherein the second power level is determined as a function of the deviation, and
- wherein said burner is transitioned back to the first operating state after a predetermined period of time has elapsed.

2. The method according to claim 1, wherein the transition from the first to the second operating state or from the second to the first operating state is carried out in steps via one power level or a plurality of power levels between the first and second power level.

3. The method according to claim 2, wherein the following method steps are carried out during the transition from the second to the first operating state in each power level between the first and second power level:
- operating said burner at the current power level;
- measuring the ionization current;
- comparing the measured ionization current with the specified target value and determining the deviation; and
- when the deviation exceeds the specified limit, transitioning said burner to the next higher power level.

4. A method for operating a burner assembly comprising a burner burning an air-fuel mixture, said method comprising the method steps of:
- specifying a target value for an ionization current;
- operating said burner in a first operating state at a first specified power level;
- measuring an ionization current by means of an ionization electrode;
- comparing the measured ionization current with the specified target value and determining a deviation; and
- when the deviation exceeds a specified limit:
- transitioning said burner to a second operating state at a second power level,
- wherein the second power level is higher than the first power level,
- wherein the second power level is determined as a function of the deviation, and
- wherein the target value is specified as a function of the current power level.

5. A method for operating a burner assembly comprising a burner burning an air-fuel mixture, said method comprising the method steps of:
- specifying a target value for an ionization current;
- operating said burner in a first operating state at a first specified power level;
- measuring an ionization current by means of an ionization electrode;
- comparing the measured ionization current with the specified target value and determining a deviation; and
- when the deviation exceeds a specified limit:
- transitioning said burner to a second operating state at a second power level,
- wherein the second power level is higher than the first power level,
- wherein the second power level is determined as a function of the deviation, and
- wherein a modulation rate of said burner when transitioning said burner to a higher power level is made faster by means of a coefficient.

6. A method for operating a burner assembly comprising a burner burning an air-fuel mixture, said method comprising the method steps of:
- specifying a target value for an ionization current;
- operating said burner in a first operating state at a first specified power level;

measuring an ionization current by means of an ionization electrode;

comparing the measured ionization current with the specified target value and determining a deviation; and when the deviation exceeds a specified limit:

transitioning said burner to a second operating state at a second power level, wherein the second power level is higher than the first power level, wherein the second power level is determined as a function of the deviation, and wherein a time duration of the deviation is determined and the second power level is determined as a function of the duration of the deviation.

7. A burner assembly for a heating boiler, said burner assembly comprising:

a burner for burning an air-fuel mixture;

an ionization electrode which is arranged on said burner, protrudes into a flame during combustion and outputs an ionization current;

a control device for controlling the combustion process, wherein said control device is configured to carry out a method comprising:

specifying a target value for an ionization current;

operating said burner in a first operating state at a first specified power level;

measuring an ionization current by means of the ionization electrode;

comparing the measured ionization current with the specified target value and determining a deviation; and when the deviation exceeds a specified limit:

transitioning said burner to a second operating state at a second power level, wherein the second power level is higher than the first power level, wherein the second power level is determined as a function of the deviation, and wherein said burner is transitioned back to the first operating state after a predetermined period of time has elapsed.

* * * * *